US005139346A

United States Patent [19]

Watanabe et al.

[11] Patent Number: 5,139,346

[45] Date of Patent: Aug. 18, 1992

[54] FLEXIBLE CONTAINER

[75] Inventors: Sumio Watanabe; Nobuhiko Ishizu, both of Osaka, Japan

[73] Assignee: Taiyo Kogyo Corporation, Osaka, Japan

[21] Appl. No.: 775,385

[22] Filed: Oct. 15, 1991

[30] Foreign Application Priority Data

Oct. 16, 1990 [JP] Japan ..... 2-278652

[51] Int. Cl.[5] ..... B65D 30/10; B65D 33/36

[52] U.S. Cl. ..... 383/107; 383/41; 383/67

[58] Field of Search ..... 383/41, 67, 71, 107, 383/904, 906

[56] References Cited

U.S. PATENT DOCUMENTS

| | | | |
|---|---|---|---|
| 2,730,150 | 1/1956 | Wunderwald et al. | 383/904 X |
| 3,105,617 | 10/1963 | Felldin | 383/67 X |
| 3,893,595 | 7/1975 | Khanna et al. | 383/67 X |
| 4,597,102 | 6/1986 | Nattrass | 383/107 X |
| 4,646,367 | 2/1987 | Nattrass | 383/20 |
| 4,781,473 | 11/1988 | LaFleur | 383/16 |
| 4,781,475 | 11/1988 | LaFleur | 383/119 |
| 4,798,572 | 1/1989 | LaFleur et al. | 493/195 |

FOREIGN PATENT DOCUMENTS

| | | | |
|---|---|---|---|
| 2634468 | 1/1990 | France | 383/107 |
| 139383 | 5/1990 | Japan | 383/904 |
| 293644 | 7/1928 | United Kingdom | 383/906 |
| 2140776 | 12/1984 | United Kingdom | 383/904 |

*Primary Examiner*—Stephen Marcus
*Assistant Examiner*—Jes F. Pascua
*Attorney, Agent, or Firm*—Nikaido, Marmelstein, Murray & Oram

[57] ABSTRACT

In a flexible container, there is provided three or more approximately rectangular main sheets, and a rectangular inlet sheet and outlet sheet are provided on an imaginary line passing through approximately the central part in the width direction of each of the main sheets. One end of each of the inlet sheet and the outlet sheet in the direction along the imaginary line is sewed to an end of the main sheet corresponding to the one end, and the other end of each of the inlet sheet and the outlet sheet is projected away from the main sheet in the direction along the imaginary line. The imaginary lines of assembly sheets each constituted by the three types of sheets conform to one another, opposed surfaces of the adjacent assembly sheets are joined to each other, and outer side edges of the adjacent assembly sheets are sewed together.

3 Claims, 10 Drawing Sheets

FLEXIBLE CONTAINER

BACKGROUND OF THE INVENTION

1. Field of the Invention

The present invention relates to a flexible container used in, for example, transporting granules in large quantities and a method of fabricating the same.

2. Description of the Prior Art

A flexible container generally has a cylindrical container body for storing granules, a cylindrical inlet portion mounted on the upper end of the container body, and a cylindrical outlet portion mounted on the lower end of the container body.

In using the above described flexible container, the outlet portion is first closed and then, granules are fed into the container body through the inlet portion. When this feeding is completed, the inlet portion is closed and then, the flexible container is conveyed to a destination. The outlet portion is then opened with the flexible container being hung, for example. Consequently, the granules in the container body are discharged into a predetermined position through the outlet portion.

Meanwhile, in fabricating the flexible container of the above described construction, the main body, the inlet portion and the outlet portion respectively formed in a cylindrical shape are sewed together. However, they are all in a three-dimensional shape, so that the above sewing work is performed in a three-dimensional manner. Accordingly, it is very difficult to mechanize the above sewing work. Consequently, the above sewing work depends on hand work in the present condition. However, such work requires a lot of labor.

SUMMARY OF THE INVENTION

An object of the present invention is to simplify the fabricating work of a flexible container to allow the mechanization, thereby to make it possible to easily fabricate the flexible container.

In a flexible container according to the present invention, there are provided three or more approximately rectangular main sheets, and a rectangular inlet sheet and outlet sheet are provided on an imaginary line passing through approximately the central part in the width direction of each of the main sheets. In addition, one end of each of the inlet sheet and the outlet sheet in the direction along the above imaginary line is sewed to an end of the main sheet corresponding to the one end, and the other end of each of the inlet sheet and the outlet sheet is projected away from the main sheet in the direction along the above imaginary line. The above three types of sheets constitute assembly sheets. The imaginary lines of the assembly sheets conform to one another, opposed surfaces of the adjacent assembly sheets are joined to each other, and outer side edges of the adjacent assembly sheets are sewed together.

Furthermore, a method of fabricating a flexible container according to the present invention comprises a first step of forming three or more approximately rectangular main sheets out of a longitudinal raw material sheet; a second step of setting an imaginary line passing through approximately the central part in the width direction of each of the above main sheets to dispose a rectangular inlet sheet and outlet sheet on the imaginary line. sewing one end of each of the inlet sheet and the outlet sheet in the direction along the above imaginary line to an end of the main sheet corresponding to the one end, and projecting the other end of each of the inlet sheet and the outlet sheet away from the main sheet in the direction along the above imaginary line; a third step of respectively folding assembly sheets each constituted by the above three types of sheets along the imaginary lines so that outwardly folding lines of the assembly sheets due to the folding conform to one another and the surfaces of the adjacent assembly sheets on the side of the outwardly folding lines are joined to each other; and a fourth step of sewing outer side edges of the above adjacent assembly sheets together.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is an exploded perspective view showing four assembly sheets which correspond to one another;

FIGS. 2 and 3 are perspective views showing a first step;

FIGS. 4 and 5 are perspective views showing a second step;

FIG. 6 is a side view showing a third step;

FIG. 7 is an exploded perspective view showing the third step;

FIG. 8 is a side view showing the third step;

FIG. 9 is a perspective view showing the third step and a forth step;

FIG. 10 is a perspective view showing a flexible container formed;

FIG. 11 is a perspective view showing the flexible container being used as viewed from above;

FIG. 12 is a partial perspective view showing the flexible container being used as viewed from below;

FIG. 13 is a perspective view showing a modified example of a main sheet; FIG. 14 is a diagram corresponding to FIG. 5; and FIG. 15 is a diagram corresponding to FIG. 11.

DESCRIPTION OF THE PREFERRED EMBODIMENTS

FIGS. 1 to 13 show a first embodiment.

Referring to FIGS. 1, 7, and 9 to 12, description is now made of a flexible container 1. For convenience of illustration, the direction indicated by an arrow Fr in FIGS. 1 and 7 shall be the forward direction.

Figure 7:
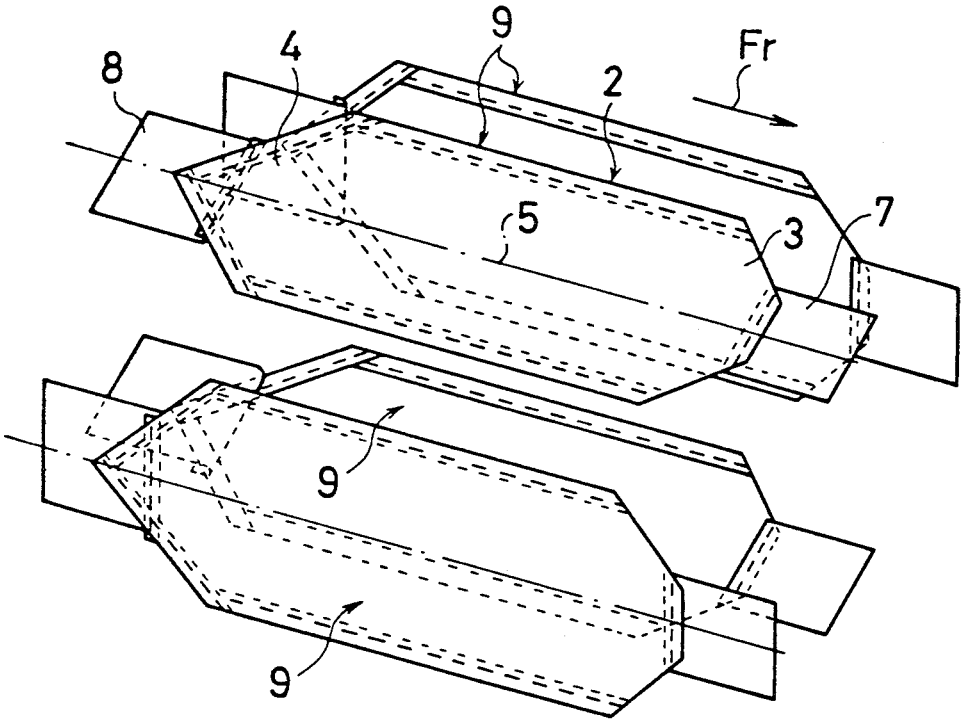

In FIG. 7, the flexible container 1 has four rectangular main sheets 2. A front angular portion 3 in a trapezoidal shape which is one type of angular shape is formed in the front edge of each of the main sheets 2, and a rear angular portion 4 in a triangular shape which is also one type of angular shape is formed in the rear edge of the main sheet 2.

An imaginary line 5 passing through approximately the central part in the width direction of the main sheet 2 including the front angular portion 3 and the rear angular portion 4. An inlet sheet 7 and an outlet sheet 8 having a width smaller than that of the above main sheet 2 are provided on the imaginary line 5. The above imaginary line 5 is almost the center line of the inlet sheet 7 and the outlet sheet 8.

The rear end of the inlet sheet 7 in the direction along the above imaginary line 5 is superimposed on the top of the front angular portion 3 on the side of one surface of the main sheet 2 and is sewed thereto. On the other hand, the front end of the above inlet sheet 7 is projected forward from the main sheet 2.

In the above described case, the width of the outlet sheet 8 is made larger than that of the inlet sheet 7. In addition, the main sheet 2 is formed out of a flexible but slightly hard sheet because it requires strength. The inlet sheet 7 and the outlet sheet 8 are formed out of a flexible soft sheet.

The front end of the outlet sheet 8 in the direction along the above imaginary line 5 is superimposed on the top of the rear angular portion 4 on the side of the above one surface of the main sheet 2 and is sewed thereto. On the other hand, the rear end of the outlet sheet 8 is projected outward from the main sheet 2.

Figure 1:
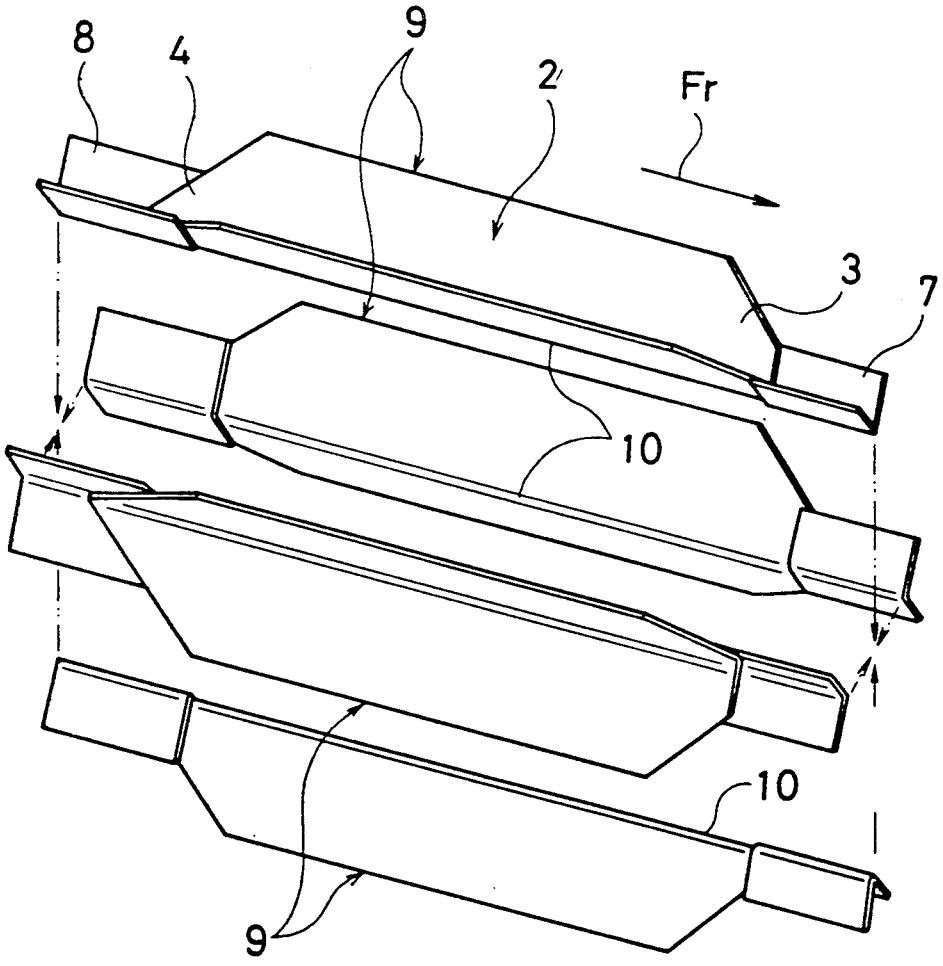
FIGS. 1 to 13 show a first embodiment of the present invention, where

In FIG. 7, three types of sheets, that is, the main sheets 2, the inlet sheets 7, and the outlet sheets 8 constitute assembly sheets 9, as described above. Each of the assembly sheets 9 is folded along the above imaginary line 5, as shown in FIG. 1. In this case, an outwardly folding line 10 due to this folding shall occur on the side of the above one surface of the main sheet 2.

Figure 9:
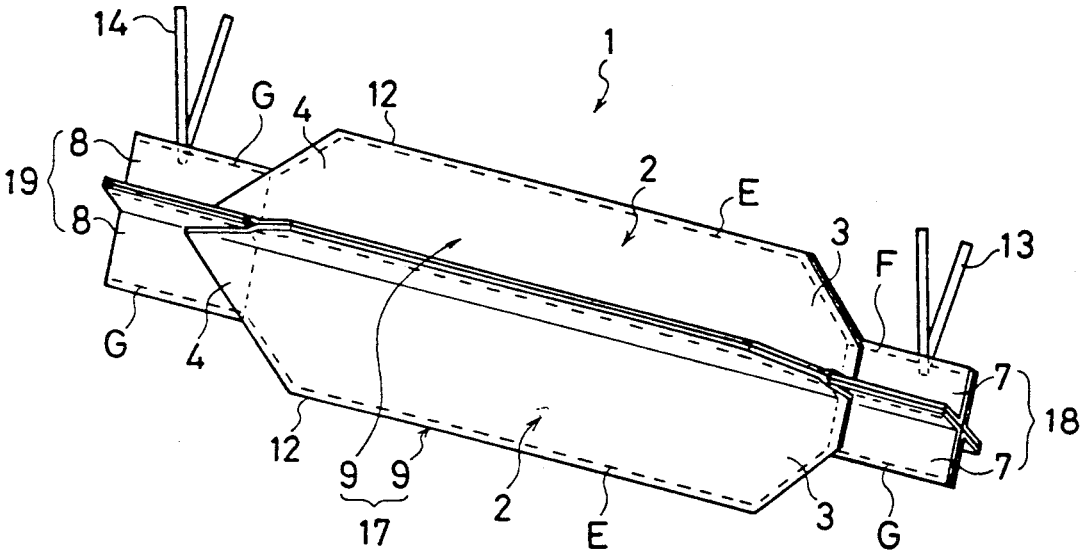

As shown in FIG. 1, the respective outwardly folding lines 10 of the assembly sheets 9 correspond to one another, as shown in FIG. 1. The above imaginary lines 5 conform to one another, as shown in FIG. 9, that is, the outwardly folding lines 10 conform to one another. Furthermore, in this case, the above respective one surfaces of the main sheets 2 in the adjacent assembly sheets 9 are joined to each other. That is, the respective surfaces of the main sheets 2 on the side of the outwardly folding lines 10 are joined to one another.

As shown in FIG. 9, outer side edges 12 of the adjacent assembly sheets 9 are sewed together. Furthermore, in the case of this sewing, an inlet binding cord 13 is inserted between the outer side edges 12 corresponding to the inlet sheets 7. This inlet binding cord 13 is sewed to the outer side edges 12 simultaneously with the sewing of the above outer side edges 12.

Furthermore, an outlet binding cord 14 is inserted between the outer side edges 12 corresponding to the outlet sheets 8. This outlet binding cord 14 is also sewed to the outer side edges 12 simultaneously with the sewing of the above outer side edges 12.

Figure 10:
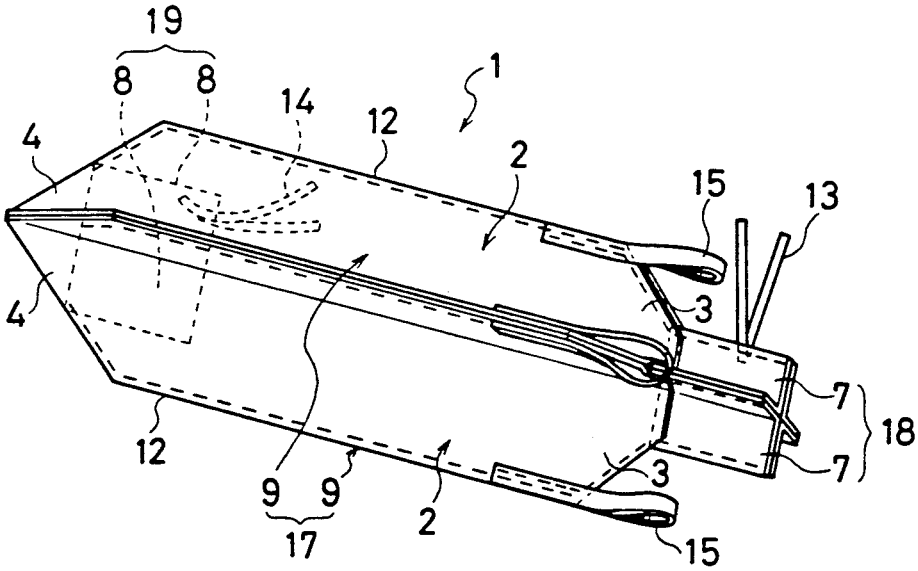

As shown in FIG. 10, hanging cords 15 are respectively sewed to front ends of the outer side edges 12 corresponding to the main sheets 2.

Figure 11:
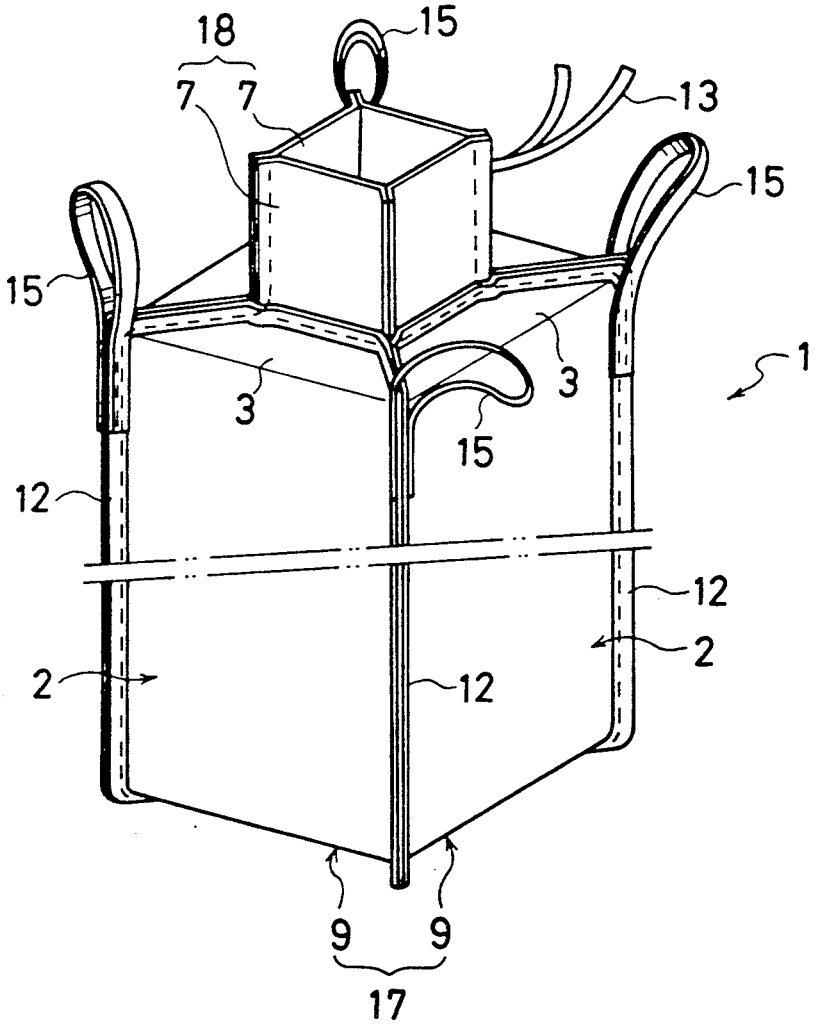
Figure 12:
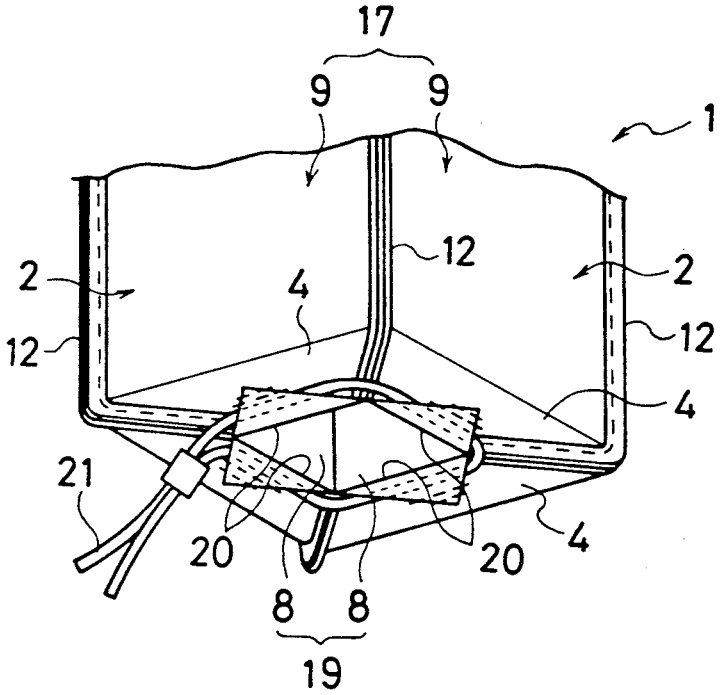

In FIGS. 11 and 12, the four main sheets 2 are sewed together in the outer side edges 12 as described above, thereby to form a container body 17 for storing granules or the like. In addition, the four inlet sheets 7 are sewed together in the outer side edges 12, thereby to form a cylindrical inlet portion 18. Furthermore, the four outlet sheets 8 are sewed together in the outer side edges 12. thereby to form a cylindrical outlet portion 19.

Particularly in FIG. 12, the top of each of the rear angular portions 4 is folded and sewed to the main sheet 2, and another outlet binding cord 21 is inserted in an annular portion 20 thus formed.

The state where the flexible container 1 of the above described construction is used is illustrated.

First, the flexible container 1 is hung by the respective hanging cords 15. The outlet portion 19 is bound with the outlet binding cord 14 to close the outlet portion 19. The outlet portion 19 is pushed into the container body 17, as shown in FIGS. 10 and 12. Then, the other outlet binding cord 21 is then tightened, to further reliably close the above outlet portion 19. The granules are fed into the container body 17 through the inlet portion 18.

When this feeding is completed, the inlet portion 18 is bound with the inlet binding cord 13 to close the inlet portion 18 and then, the flexible container 1 is conveyed to a destination. Then, the other outlet binding cord 21 is loosened with the flexible container 1 being hung as described above. In addition, the outlet portion 19 is pulled out of the container body 17 and the outlet binding cord 14 is loosened. The outlet portion 19 is then opened. Consequently, the granules in the container body 17 are discharged into a predetermined position.

Figure 13:
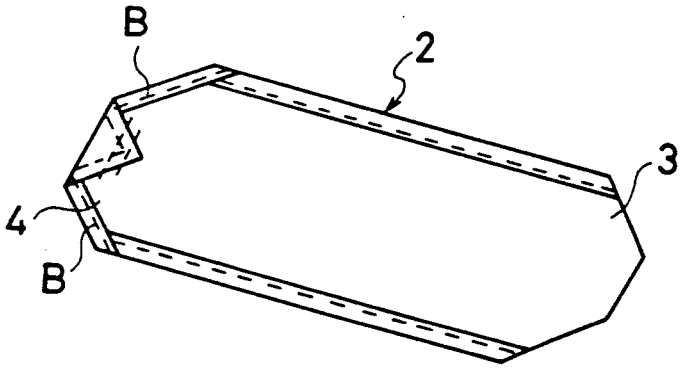

As shown in FIG. 13, the above rear angular portion 4 may be in a trapezoidal shape obtained by folding the top thereof and sewing the same to the main sheet 2. In addition, the front angular portion 3 may be in a triangular shape, which is not shown.

Description is now made of a method of fabricating the flexible container 1 of the above construction.

The initial steps in the fabricating method are as follows.

Figure 2:
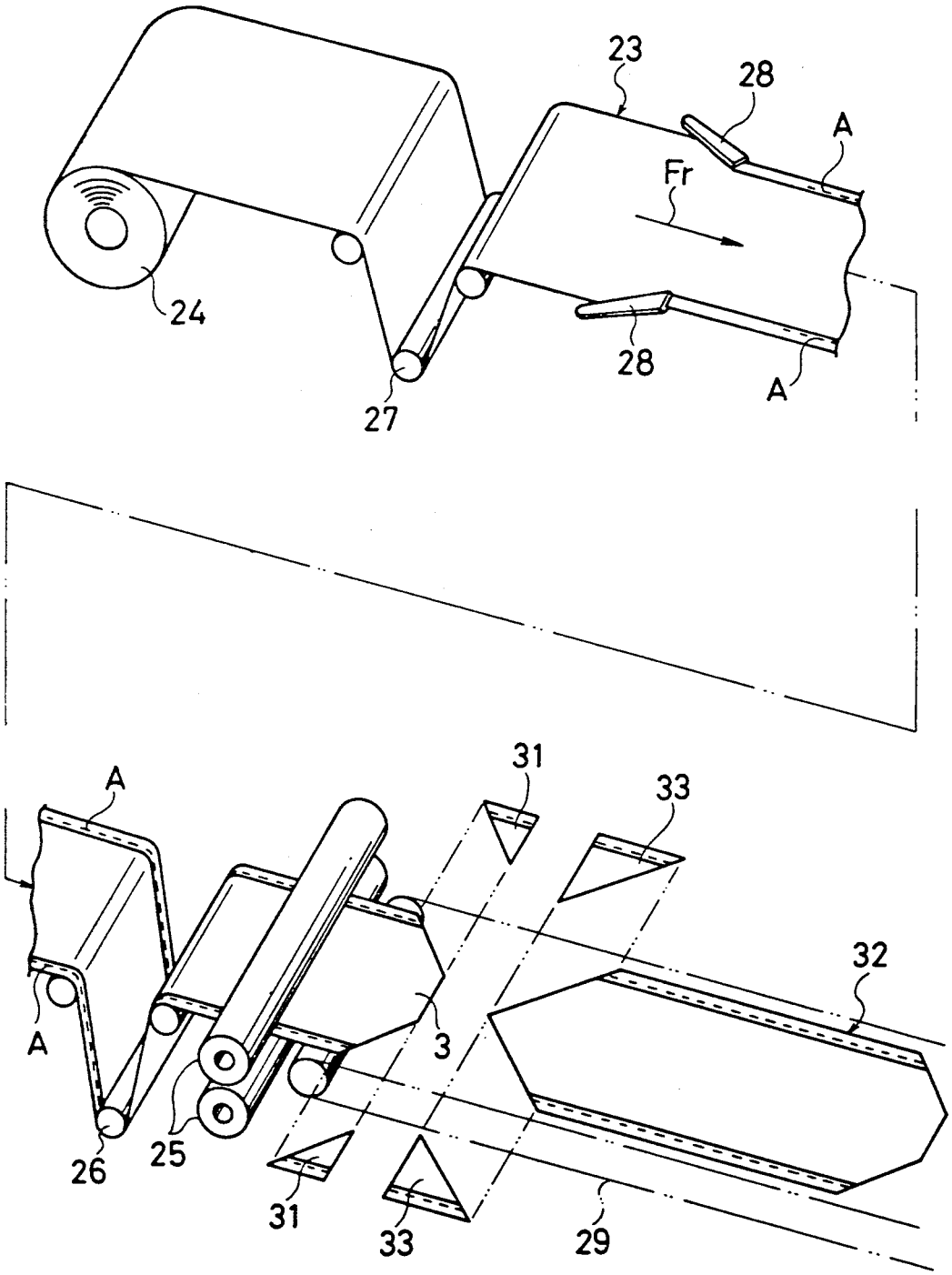

In FIG. 2, reference numeral 23 denotes a raw material sheet. This raw material sheet 23 is a flexible longitudinal material such as a vinyl sheet and a nonwoven fabric. There is provided a roll 24 around which the raw material sheet 23 is wound. One end of the above raw material sheet 23 fed from the roll 24 is sandwiched from above and below between a pair of pullout rollers 25, to be pulled out forward as indicated by an arrow Fr in FIG. 2. The pullout rollers 25 are driven by an electric motor.

Front and rear tension rollers 26 and 27 are provided between the roll 24 and the pullout rollers 25. Some degree of tension is given to the raw material sheet 23 by the tension rollers 26 and 27.

A pair of right and left folding fittings 28 is provided between the above front and rear tension rollers 26 and 27. Outer side edges of the raw material sheet 23 pulled out in the above described manner are brought into contact with the folding fittings 28, so that the outer side edges are folded on the side of the upper surface of the raw material sheet 23. The folded portions are sewed to the raw material sheet 23 (portions A in FIG. 2), to give predetermined strength to the outer side edges of the raw material sheet 23.

The first step is as follows.

In FIG. 2, the raw material sheet 23 passed between the above pullout rollers 25 is further fed forward by a conveyer 29. In this case, respective corner portions 31 in ends in the width direction in the front edge of the raw material sheet 23 are cut and removed, thereby to form the above described front angular portion 3.

Furthermore, the raw material sheet 23 is cut to predetermined lengths on the conveyer 29, to form an intermediate object 32. Respective corner portions 33 in ends in the width direction in the rear edge of this intermediate object 32 are cut and removed, so that the rear edge of the intermediate object 32 is made triangular.

Figure 3:
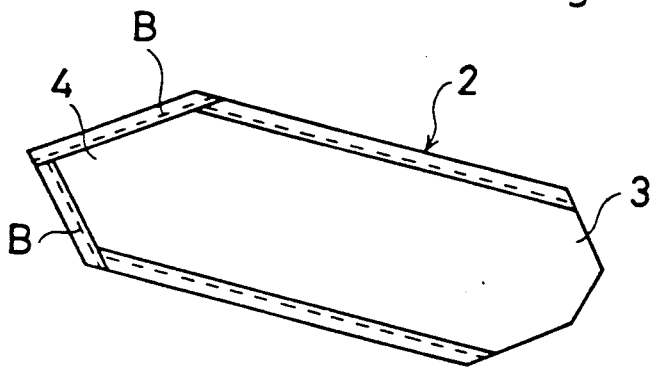

In FIG. 3, the rear edge of the above intermediate object 32 shown in FIG. 2 is folded on the side of the upper surface of the intermediate object 32, and folded portions are sewed to the intermediate object 32 (portions B in FIG. 3). Consequently, the above described main sheet 2 is formed, and the above described rear angular portion 4 is formed in the rear edge of the main sheet 2.

The second step is as follows.

Figure 4:
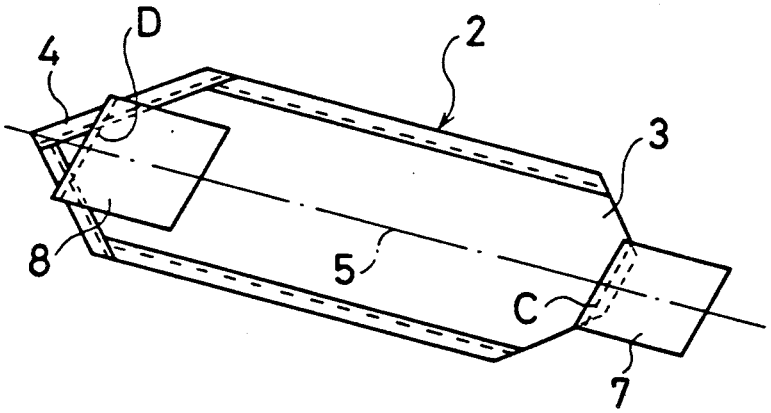

In FIG. 4, an imaginary line 5 passing through the center in the width direction of the main sheet 2 including the front angular portion 3 and the rear angular portion 4 is set. A rectangular inlet sheet 7 and outlet sheet 8 having a width smaller than that of the above main sheet 2 are disposed on the imaginary line 5.

The rear end of the inlet sheet 7 in the direction along the above imaginary line 5 is superimposed on the top of the front angular portion 3 on the side of the upper surface of the main sheet 2 and is sewed thereto (a portion C in FIG. 4). In this case, the front end of the inlet sheet 7 is projected forward from the main sheet 2.

Furthermore, one end of the outlet sheet 8 in the direction along the above imaginary line 5 is superimposed on the top of the rear angular portion 4 on the side of the upper surface of the main sheet 2 and is sewed thereto (a portion D in FIG. 4). In this case, the other end of the outlet sheet 8 extends forward.

Figure 5:
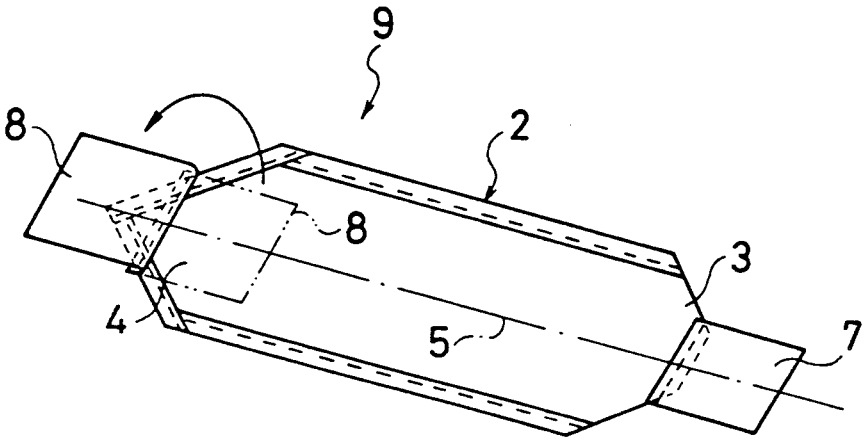

In FIG. 5, a free end which is the other end of the above outlet sheet 8 is folded backward, and the rear end of the outlet sheet 8 folded is projected backward from the main sheet 2. In this manner, assembly sheets are constituted by main sheets 2, inlet sheets 7, and outlet sheets 8 from one to another.

The third step is as follows.

Figure 6:
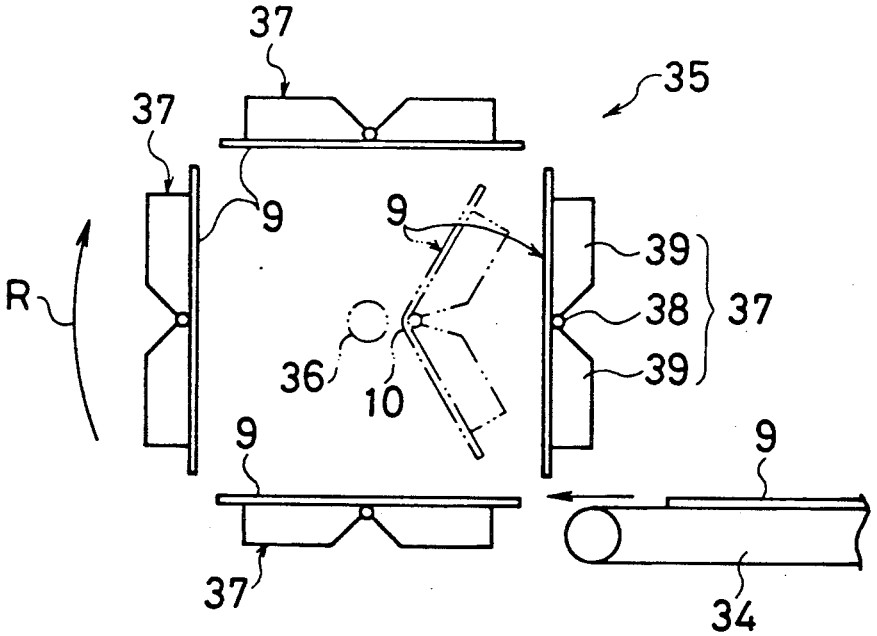

In FIG. 6, the above assembly sheet 9 is conveyed in the horizontal direction (the lateral direction) at right angles to the above described imaginary lines 5 by a conveyer 34. An assembling unit 35 for assembling four assembly sheets 9 is provided ahead of this conveyer 34 in the lateral direction.

This assembling unit 35 has four supporting stands 37 equally spaced in the peripheral direction around a horizontal pivot shaft 36 parallel to the imaginary lines 5. The supporting stands 37 are rotatable about the above pivot shaft 36, as indicated by an arrow R in FIG. 6. In addition, each of the supporting stands 37 is constituted by a pair of rotating stands 39 pivotably supported by a hinge 38, The relative angle between the rotating stands 39 is made variable around the above hinge 38.

The upper surface of one of the above supporting stands 37 and the front end of the above conveyer 34 are approximately coplanar. The assembly sheet 9 fed from the conveyer 34 is fed onto the above supporting stand 37. This supporting stand 37 can absorb the above assembly sheet 9 by air suction. When the assembly sheet 9 is fed onto the supporting stand 37 so that the imaginary line 5 corresponds to the hinge 38, the assembly sheet 9 is adsorbed and fixed to the supporting stand 37. Then, each of the supporting stands 37 is rotated by 90° about the above pivot shaft 36, so that the next supporting stand 37 is located ahead of the conveyer 34.

The same operation as the foregoing operation is repeated, so that four assembly sheets 9 are equally spaced around the pivot shaft 36, as shown in FIGS. 6 and 7.

Each of the rotating stands 39 is relatively rotated about the hinge 38, as indicated by an imaginary line in FIG. 6. Consequently, each of the assembly sheets 9 is folded along the imaginary line 5, as indicated by an imaginary line in FIG. 6 and FIG. 1.

Figure 8:
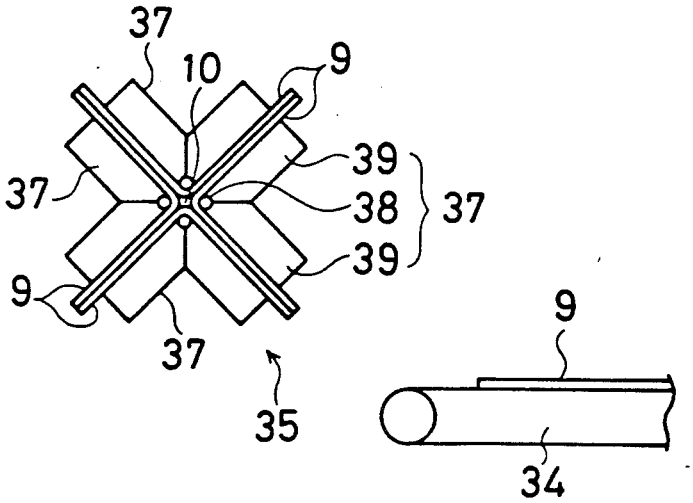

In FIGS. 8 and 9, the supporting stands 37 are close to one another with a pair of rotating stands 39 in each of the supporting stands 37 being relatively rotated by 90°. Accordingly, the outwardly folding lines 10 of the assembly sheets 9 conform to one another. In addition, at this time, the surfaces of the adjacent assembly sheets 9 on the side of the outwardly folding lines 10 are joined to each other.

The fourth step is as follows.

As shown in FIG. 9, the outer side edges 12 of the adjacent assembly sheets 9 are sewed together by a sewing machine (portions E, F and G in FIG. 9).

The method of mounting or forming the inlet binding cord 13, the outlet binding cord 14, the hanging cord 15, the annular portion 20, and the other outlet binding cord 21 is as described above.

Although the foregoing is an example illustrated, the number of main sheets 2 is, for example, three or six.

Figure 14:
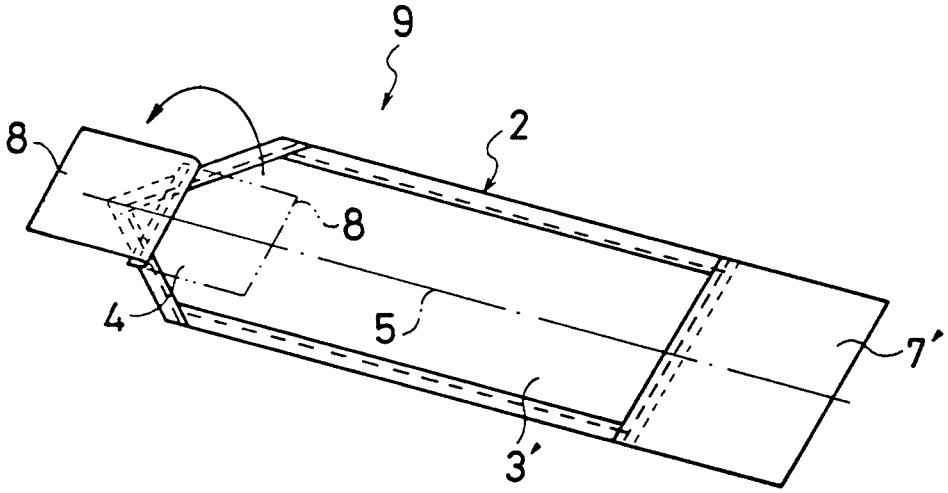
FIGS. 14 and 15 show a second embodiment, where
Figure 15:
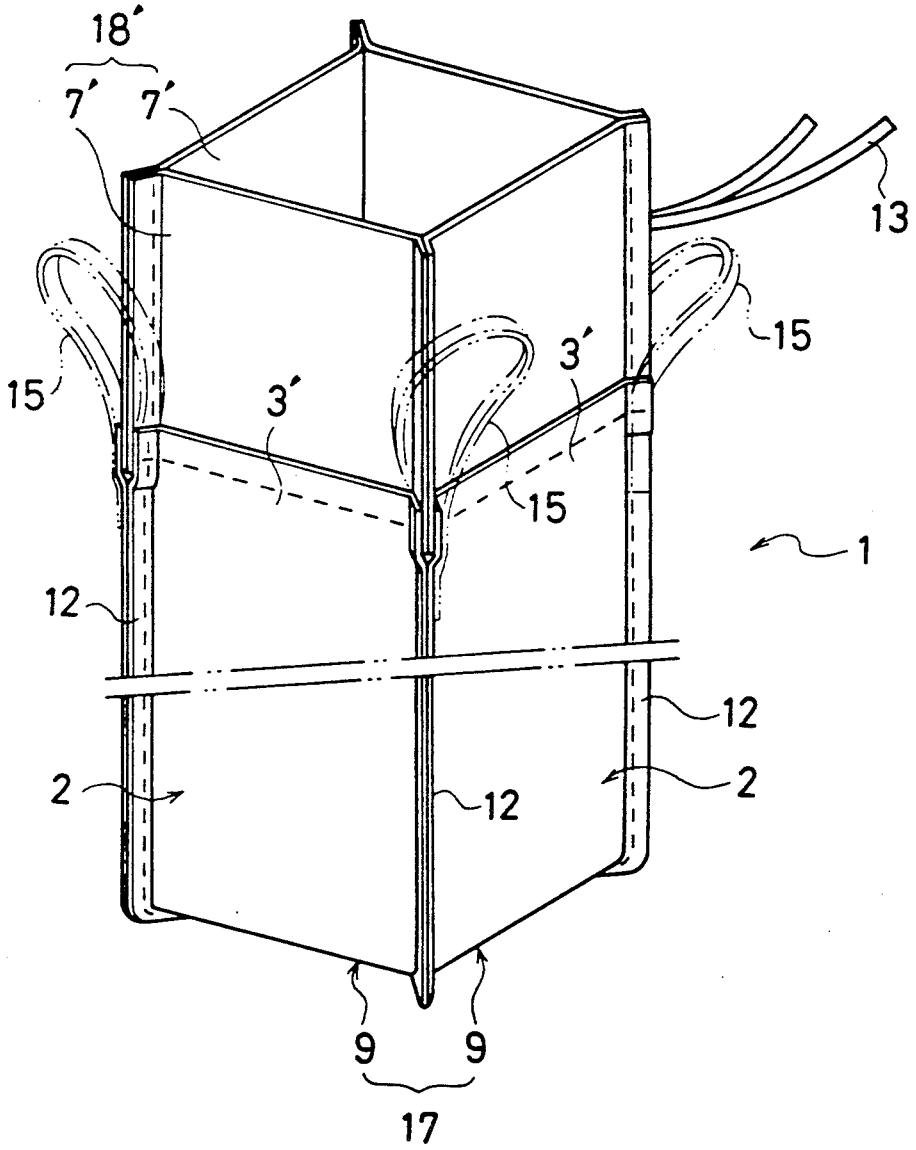

FIGS. 14 and 15 show a second embodiment.

FIG. 14 is a diagram corresponding to FIG. 5 showing the above described first embodiment. In FIG. 14, a front edge 3' of a main sheet 2 remains in a rectangular shape. An inlet sheet 7' having approximately the same width as that of the main sheet 2 is sewed to the front edge 3'.

FIG. 15 is a diagram corresponding to FIG. 11 showing the above described first embodiment. In FIG. 15, the main sheet 2 and the inlet sheet 7' have the same width. Accordingly, the cross sectional shape of a container body 17 and the cross sectional shape of an inlet portion 18' are almost the same.

The other construction and the other fabricating method of the flexible container 1 are the same as those in the above described first embodiment and hence, the description thereof is omitted by assigning reference numerals in the drawings.

As described in the foregoing using FIGS. 4 and 5 or FIG. 14, the main sheet 2, the inlet sheet 7, and the outlet sheet 8 are sewed together to form the assembly sheet 9 in a flat manner, that is, in a two-dimensional manner. Accordingly, it is possible to perform the sewing work simply.

Furthermore, the assembly sheets thus formed are respectively in a flat shape. When each of the assembly sheets 9 is folded along the imaginary line 5 passing through approximately its central part in the width direction, as shown in FIGS. 1 and 8, therefore, it is possible to perform the folding work simply.

Additionally, the imaginary lines 5 of the assembly sheets 9 conform to one another and the opposed surfaces of the adjacent assembly sheets 9 are joined to each other as shown in FIG. 8, and the outer side edges 12 of the above adjacent assembly sheets 9 are sewed together as shown in FIG. 9, thereby to complete the sewing of the flexible container 1. The above sewing is intended for not portions near the center of the assembly sheets 9 but the outer side edges 12 which the sewing machine can readily approach. Moreover, the above outer side edges 12 of the assembly sheets 9 are in a flat shape. Consequently, the above outer side edges 12 can be sewed together by two-dimensional simple work.

Accordingly, the fabricating work of the flexible container 1 is simpler than that in the conventional example, to make it sufficiently possible to mechanize the flexible container 1. Consequently, the fabrication of the flexible container is rapidly facilitated, as compared with the conventional case where the fabrication of the flexible container is forced to depend on hand work.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. In a flexible container formed by sewing a plurality of sheets together, the flexible container wherein there is provided three or more approximately rectangular main sheets, a rectangular inlet sheet and outlet sheet are provided on an imaginary line passing through approximately the central part in the width direction of each of the main sheets, one end of each of said inlet sheet and said outlet sheet in the direction along said imaginary line is sewed to an end of the main sheet corresponding to the one end, the other end of each of said inlet sheet and said outlet sheet is projected away from the main sheet in the direction along said imaginary line, the imaginary lines of assembly sheets each constituted by said three types of sheets conform to one another, and opposed surfaces of the adjacent assembly sheets are joined to each other, and outer side edges of the adjacent assembly sheets are sewed together.

2. The flexible container according to claim 1, wherein each of ends of said main sheet in the direction along the imaginary line is in an angular shape, and the width of each of the inlet sheet and the outlet sheet is smaller than that of the main sheet.

3. The flexible container according to claim 2, wherein the width of the outlet sheet is larger than that of the inlet sheet.

* * * * *